US005557871A

United States Patent [19]

LaLonde

[11] Patent Number: 5,557,871

[45] Date of Patent: Sep. 24, 1996

[54] BRUSH FOR CLEANING THE BORE OF A GUN BARREL

[76] Inventor: Anthony F. LaLonde, P.O. Box H, San Jose, Calif. 95151

[21] Appl. No.: 431,664

[22] Filed: May 2, 1995

[51] Int. Cl.[6] ..... F41A 29/02

[52] U.S. Cl. ..... 42/95; 15/104.2; 15/104.165; 15/206; 15/207.2

[58] Field of Search ..... 42/95; 15/206, 15/207.2, 207, DIG. 6, 200, 104.16, 104.165, 104.2, 114

[56] References Cited

U.S. PATENT DOCUMENTS

| | | | |
|---|---|---|---|
| 1,043,533 | 11/1912 | Nolan et al. . | |
| 1,516,438 | 11/1924 | Inskip . | |
| 1,979,240 | 11/1934 | Adelmann | 15/198 |
| 2,074,213 | 3/1937 | Deem | 15/104.20 |
| 2,824,322 | 2/1958 | Angelica et al. | 15/104.09 |
| 2,897,525 | 8/1959 | Goodwin et al. | 15/104.165 |
| 3,186,019 | 6/1965 | Hattori | 15/179 |
| 4,222,142 | 9/1980 | DiProspero | 15/104.165 |
| 4,291,477 | 9/1981 | Carlton | 42/95 |
| 4,503,578 | 3/1985 | McIntyre | 15/104.165 |
| 4,509,223 | 4/1985 | Sipple et al. | 15/160 |
| 4,756,044 | 7/1988 | Clark | 15/182 |
| 4,858,360 | 8/1989 | Hardin | 42/95 |
| 4,936,170 | 6/1990 | Zumeta | 81/180.1 |
| 4,967,439 | 11/1990 | LaLonde . | |
| 5,031,488 | 7/1991 | Zumeta | 81/180.1 |
| 5,150,315 | 9/1992 | Katzin | 364/709.02 |
| 5,171,925 | 12/1992 | Mekler | 42/95 |
| 5,253,386 | 10/1993 | LaLonde | 15/206 |
| 5,318,052 | 6/1994 | Ivanov | 132/238 |
| 5,394,584 | 3/1995 | Breitschmid | 15/167.1 |

*Primary Examiner*—Michael J. Carone
*Assistant Examiner*—Christopher K. Montgomery
*Attorney, Agent, or Firm*—Jack M. Wiseman

[57] ABSTRACT

A brush for cleaning the bore of a gun barrel includes groups of metal bristles and groups of nylon bristles secured to a twisted wire strand. The metal and the nylon bristles are formed into segregated groups and are arranged in successive and alternate sections with the nylon bristles on each side of the metal bristles. The metal bristles are phosphor bronze. The nylon bristles are colored in accordance with a color code to provide ease in identifying the correct brush size to clean a specific caliber bore. The brush also includes a cleaning cloth holder at the end thereof opposite from the end of the brush holding the bristles. The cleaning brush holder includes a small loop and a larger loop for holding different size cleaning cloths.

13 Claims, 2 Drawing Sheets

FIG_1
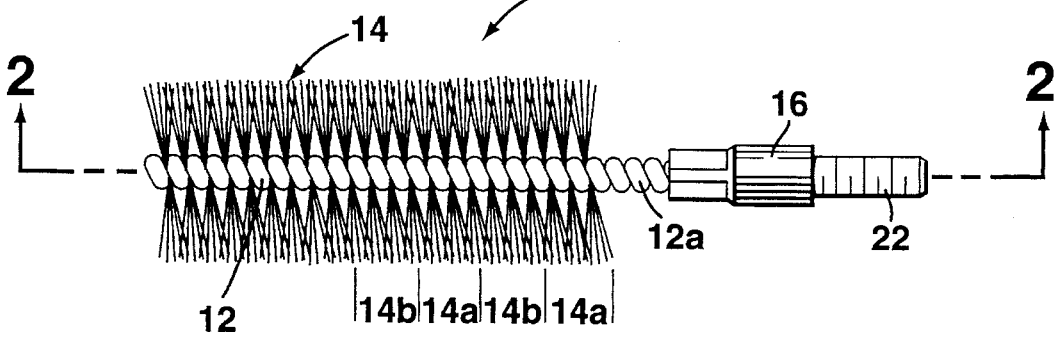
FIG_2
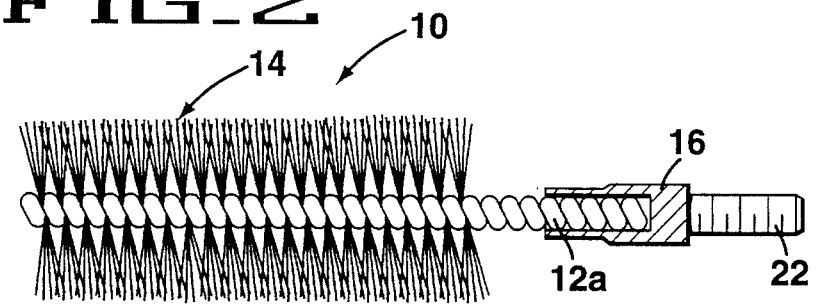
FIG_3
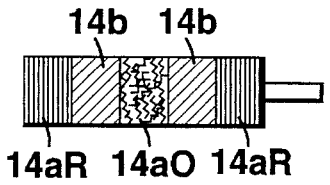
FIG_4
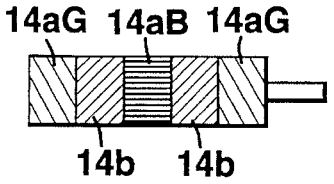
FIG_5
TABLE I
| SHOT GUN SIZE | COLOR CODE |
|---|---|
| 4/10 SHOT GUN | BLUE |
| 16 GA | RED |
| 20 GA | ORANGE |
| 12 GA | GREEN |
| 10 GA | YELLOW |
FIG_6
TABLE II
| RIFLE SIZE | COLOR CODE |
|---|---|
| 22 CALIBER | BLUE |
| 30 CALIBER | RED |
| 35 CALIBER | ORANGE |
| 243 / 25 CALIBER | GREEN |
| 32 CALIBER | YELLOW |
| 38 CALIBER | BLUE & RED |
| 44 / 45 CALIBER | ORANGE & GREEN |

BRUSH FOR CLEANING THE BORE OF A GUN BARREL

BACKGROUND OF THE INVENTION

The present invention relates, in general, to brushes and, more particularly, to brushes for cleaning the bores of gun barrels.

The firing of rounds in a gun causes combustion by-products to collect on the inner wall of the gun barrel. Further, the inner wall is mechanically abraded by the projectile on the round and the unburned solid particles of the charge, resulting in the accumulation of erosion substances in the bore. The accuracy of a gun is dependent on the condition of its bore. Uncontrolled build up and erosion in the bore will render the gun ineffective or unsafe. Proper care of the gun barrel involves removal of the collected combustion by-products and the erosion substance from the bore without any appreciable scouring and defacement of the inner wall.

Heretofore, the cleaning of the bore of a gun barrel employed brushes with metal bristles. Such metal bristles bend and deform under normal use. The deformation of the metal bristles renders the brush ineffective to remove combustion by-products from the bore and contributes to scouring of riflings, aggravating the erosion of the bore. Degradation of a bore due to scouring of riflings by metal bristles is highly undesirable. Further, various caliber guns have different bore dimensions which require a matching brush size for effective cleaning. Choosing the correct brush size, among for example, a batch consisting of several sizes, is difficult, particularly when cleaning guns with small caliber size differences.

The Adelmann U.S. Pat. No. 1,979,240, issued on Nov. 6, 1934, for Brush For A Washing Machine, discloses stainless steel bristles and wooden bristles. The wooden bristles tend to keep the steel bristles in their original position after displacement during normal use.

In Hattori U.S. Pat. No. 3,186,019, issued on Jun. 1, 1965, for a Circular Brush, there is disclosed a brush with symmetrical rows of clusters of natural fiber bristles and a row of clusters of metal wire bristles. The intermixing of the wire bristles with the natural fiber bristles provides elasticity and thereby improves the cleaning performance of the brush.

In Inskip U.S. Pat. No. 1,516,438, issued on Nov. 18, 1924, for Implement To Scour Rifled Firearms, discloses a device which compresses a cleaning rod with short leather sliding scouring collars and loosely fitting metal washer collars. The metal washers are used as spacers.

In Sipple et al. U.S. Pat. No. 4,509,223, issued on Apr. 9, 1985, for Gun Cleaning Tool, there is disclosed a cleaning tool with three tips for cleaning various parts of a gun. The three tips are removably insertable into a handle. The first tip is made of bristles. The second cleaning tip has a woven cotton cover fixed to it. The third tip has soft cotton fibers.

The LaLonde U.S. Pat. No. 5,253,386, issued on Oct. 19, 1993, for Brush For Cleaning Interior Of A Tube Or The Like, discloses brush bristles secured to a wire. A section of the wire is free of brush bristles and is covered by a non-abrasive, plastic cylindrical body to form a handle and an extension of the brush.

The LaLonde U.S. Pat. No. 4,967,439, issued on Nov. 6, 1990, for Device For Cleaning Wind Musical Instruments, discloses a device for cleaning an inner wall of a tube for a wind musical instrument. The device includes a semi-rigid rod formed of separable half sections which define, when contiguous to one another, an axially directed slit. A removable cloth is secured within the slit between the confronting walls of the half sections that are contiguous to one another.

SUMMARY OF THE INVENTION

A brush for cleaning the bore of a gun barrel in which a twisted wire strand is used to secure bristles comprising metallic filaments and nylon filaments. A segment of the wire strand is free of filaments. The segment of the wire free of filaments is secured to a handle for the brush.

A brush for cleaning the interior of a gun barrel in which a twisted wire strand is used to secure nylon bristles and phosphor bronze bristles which project radially from the wire strand. A segment of the wire strand is without bristles and attached to it at its proximal end is a handle for the brush.

A method of constructing a brush in which groups of metal bristles and groups of nylon bristles are disposed in segregated sections of the brush. The method of construction includes securing a group of nylon bristles in a section of the brush. A group of metal bristles are then secured contiguous to the group of nylon bristles. The process is continued to form successive and alternate sections of groups of nylon bristles and groups of metal bristles.

An object of the present invention is to provide a brush for cleaning the bore of gun barrel. Nylon bristles and phosphor bronze bristles are used to construct a brush having an extended service life.

Another object of the present invention is to provide a brush for cleaning the bore of a gun barrel which enables better cleaning and reduced maintenance.

A feature of the present invention is the employment of nylon to provide flexibility and to inhibit the deformation of the metal bristles.

Another feature of the present invention is the employment of nylon bristles to provide a non-abrasive cleaning of the inner walls of the gun barrel while the metal bristles provide effective scouring action.

Another feature of the present invention is the employment of colored nylon bristles to provide a color code to readily select the correct brush size for cleaning a specific caliber gun bore.

Another feature of the present invention is the arrangement of groups of nylon bristles and groups of metal bristles in a successive and alternate sequence, whereby a group of nylon bristle are disposed on each side of a group of metal bristles.

Another feature of the present invention is that nylon bristles may be set in accordance with a color scheme to provide a code for identifying a specific brush size.

BRIEF DESCRIPTION OF THE DRAWINGS

FIG. 1, when combined with FIG. 7, is a fragmentary elevational view of a brush embodying the present invention.

FIG. 2 is a sectional view taken along line 2—2 of FIG. 1. FIG. 3 is an elevational view showing a color coding scheme in which colored nylon bristles are arranged in a structural pattern to distinguish a specific brush size.

FIG. 4 is an elevational view showing another color coding scheme.

FIG. 5 is a table showing an exemplary color coding chart for a shotgun.

FIG. 6 is a table showing an exemplary color coding chart for a rifle.

DESCRIPTION OF THE PREFERRED EMBODIMENTS

Figure 7:
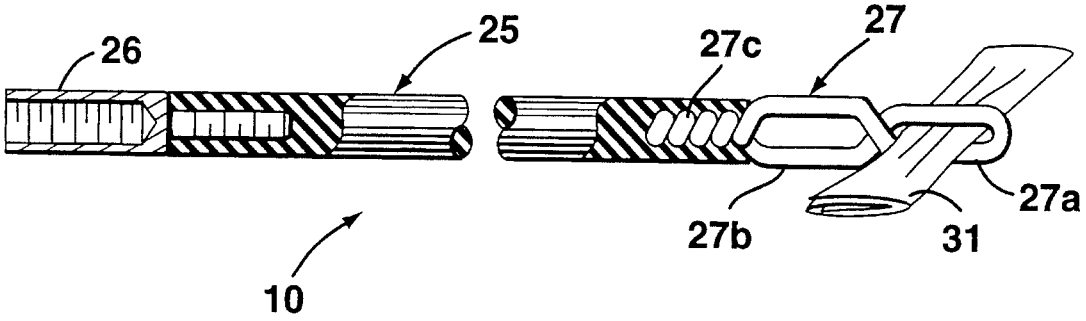
FIG. 7 is an elevational view, partially in section, of a handle and a cleaning cloth and when combined with FIG. 1 illustrates a brush embodying the present invention.

Illustrated in FIGS. 1 and 7, when FIGS. 1 and 7 are placed side-by-side with FIG. 7 placed to the right of FIG. 1, is a brush 10 including, in the exemplary embodiment, twisted wire 12. Wire 12 is made of ductile metal. In the exemplary embodiment, twisted wire 12 is made of suitable material, such as stainless steel and galvanized steel. Nylon bristles 14*a* and metal bristles 14*b* are secured in the space formed between the turns of the twisted wire 12. The nylon bristles 14*a* are commercially available and are resilient material having polymeric amide composition which are used to make fibers, fabrics, sheeting and extruded forms. The metal bristles 14*b*, in the exemplary embodiment, may be metals or alloys of metals suitable to clean particular residue without harsh scouring. In the preferred embodiment, the metal bristles 14*b* are made of phosphor bronze which are commercially available and are made of a hard copper-base alloy containing several percent tin, and sometimes smaller percentages of lead, deoxidized with phosphorus. The brush bristles 14 comprise the nylon bristles 14*a* and the phosphor bronze bristles 14*b* which are arranged in alternate and successive groups along the twisted wire 12 with the group of nylon bristles 14*a* disposed on each side of the group of phosphor bronze bristles 14*b*. The nylon bristles 14*a* and the phosphor bronze bristles 14*b* project radially from the twisted wire 12.

The twisted wire 12 includes bristle free segment 12*a*. The end of segment 12*a* is fixedly secured within a sleeve 16, which is externally threaded at the proximal end 22 for securement to a suitable flexible handle 25 (FIG. 7). The sleeve 16 is made of suitable material, such as aluminum. The handle 25 is a flexible, non-abrasive, plastic cylindrical body. In the preferred embodiment, the flexible handle 25 is initially a solid cylindrical body made of high density polypropylene or nylon. By virture of the flexible handle 25, the brush 10 is adaptable for the cleaning of bores with facility. The flexible handle 25 reduces the need for disassembling during the cleaning of firearms.

FIG. 2 is a sectional view of FIG. 1 taken along line 2—2. It depicts the securement of twisted wire 12, at the end of the bristle free end 12*a*, within the sleeve 16. The securement is made by crimping or pinching the non-threaded section of sleeve 16 after the twisted wire 12 has been inserted therein. The extended threaded end 22 of sleeve 16 serves as an attachment to the handle 25 and it is received by an internally threaded sleeve 26 secured to the handle 25 at the confronting end of the flexible handle 25 by threadedly piercing and penetrating the solid, flexible handle 25 along the center line thereof (FIG. 7). Further, FIG. 2 shows a sectional view of the brush 10. In the preferred embodiment, the groups of nylon bristles 14*a* and the groups of phosphor bronze bristles 14*b* are alternately and successively arranged.

Illustrated in FIGS. 3 and 4 are color schemes to identify the size of brush 10 for cleaning a given caliber gun. For example, a brush for cleaning a twenty-two caliber pistol may have a brush with nylon bristles 14*a* having alternating red and orange colors 14*a*R and 14*a*O, respectively. Similarly, a brush for cleaning a 32 caliber pistol may have a brush with nylon bristles 14*a* having alternating green and blue colors 14*a*G and 14*a*B, respectively. The use of such a color scheme will provide a quick identification of a brush which is suitable to clean the bore of a pistol, rifle, and/or shotgun of a known gauge or caliber size. Particularly, a gun shop or an operation which deals with the cleaning of a number of different sizes of guns, rifles and pistols will be able to select the correct brush size if the brushes are color coded in a manner advanced by the present invention.

FIGS. 5 and 6 show Tables I and II, respectively. The tables illustrate a color coding scheme to be used with colored nylon bristles. For example, in Table I, brushes for cleaning shotguns with a known size may be color coded in accordance with the table. Accordingly, for example, a brush for cleaning a 12 gauge shot gun will have a nylon bristle with a green color. Similarly, brushes for cleaning rifles with a known caliber may be color coded in accordance with Table II. Thus, for example, a brush for cleaning a 32 caliber rifle may have yellow colored nylon bristles.

It is noteworthy that a combination of colors and patterns of colored nylon bristles may be used to generate several color codes to assign a brush size to clean a a specific gun bore. The contents of Tables I and II are provided as exemplary color codes and are by no means exhaustive. Such color code charts enable a quick correlation between the size of the brush and the coded color of the nylon bristles.

With reference to FIG. 1, the groups of nylon bristles 14*a* are arranged in a successive and alternate manner relative to the groups of phosphor bronze bristles 14*b*. This arrangement provides elasticity and reboundability to the phosphor bronze bristles 14*b*. Normally, phosphor bronze bristles 14*b* bend and deform under use while cleaning the bore of a gun. Phosphor bronze bristles 14*b* tend not to spring back to their initial position. Thus, phosphor bronze bristles 14*b*, when used continuously, tend to deform and tend to be, when deformed, less effective for cleaning the gun bore. The groups of nylon bristles 14*a* located on each side of the groups of phosphor bronze bristles 14*b* inhibit permanent deformation and bending of the phosphor bronze bristles 14*b*. When the brush of the present invention is used to clean the bore of a gun, a forward stroke will tend to bend the bristles, both the nylon bristles 14*a* and the phosphor bronze bristles 14*b*, in the opposite direction. However, when the forward stroke is relieved, the nylon bristles 14*a* spring back to their initial positions. This, in turn, urges the contiguous phosphor bronze bristles 14*b* to return to their initial positions.

The arrangement of nylon bristles 14*a* and phosphor bronze bristles 14*b*, in both forward and backward scrubbing strokes, enhance efficient cleaning and keep the phosphor bronze bristles 14*b* from bending. The arrangement of nylon bristles 14*a* and phosphor bronze bristles 14*b* enables alternate harsh and gentle scrubbing actions. The phosphor bronze bristles 14*b* scour harshly and remove substances from the inner wall of a gun bore. The nylon bristles 14*a* may interrupt the harsh cleaning action and by reducing contact from the succeeding group of phosphor bronze bristles 14*b*. Accordingly, the arrangement enables the harsh scouring action of the phosphor bronze bristles 14*b* to be preceded and followed by the more gentle and a less abrasive brushing of the nylon bristles 14*a*. In a forward scrubbing stroke, the first group of nylon bristles 14*a* gently push forward any erosion substance which is loosely attached to the inner wall of the bore. The phosphor bronze bristles 14*b*, immediately behind the first group of nylon bristles 14*a*, provide abrasive brushing. Erosion substance and particulate residue removed by the phosphor bronze bristles 14*b* are gently advanced forward by the second group of nylon bristles 14*a*. A backward stroke has the same effect as a forward stroke except that the erosion substance and particulate residue are conveyed in the backward direction. In this manner, the bore is scrubbed and erosion substance gently removed in both the forward and backward strokes.

Thus, the alternate and successive placement of groups nylon bristles 14*a* relative to groups of phosphor bronze bristles 14*b* provides the advantages of smoothly conveying forward scrubbed erosion substance and particulate residue in a gun bore. This is particularly desirable when cleaning riflings which could otherwise be easily damaged by the erosion substance. By simultaneously combining gentle brushing and harsh scrubbing cycles in a single stroke, a new and efficient brush for cleaning the bore of a gun barrel is provided.

At the end of the flexible handle 25 opposite from the brush bristles 14*a* and 14*b* is a cleaning cloth holder 27 (FIG. 7). The cleaning cloth holder 27 is made of suitable material, such as stainless steel. In the exemplary embodiment, the cleaning cloth holder 27 comprises a small loop 27*a*, a larger loop 27*b* and a twisted wire shaft 27*c*. The twisted wire shaft 27*c* of the cleaning cloth holder 27 pierces and penetrates the free end of the solid, flexible handle 25 along the center line thereof. This results in the cleaning cloth holder 27 being fixedly secured to the free end of the solid, flexible handle 25. The LaLonde U.S. Pat. No. 5,253,386, describes a method by which a twisted wire is fixedly secured to the free end of a solid flexible nylon body by causing the twisted wire to pierce and penetrate the flexible nylon body. It is apparent that the shaft 27*c* can be a threaded shaft to penetrate the free end of the solid, flexible handle 25 along the center line thereof for securing the cleaning cloth holder 27 to the free end of the solid, flexible handle 25.

The small loop 27*a* receives suitable cleaning cloth 31 that extends outwardly from the signal loop 27*a*. The cleaning cloth 31 received by the small loop 27*a* is suitable for cleaning pistol bores and small bore rifles. The larger loop 27*b* receives suitable cleaning cloth 32 (FIG. 9) that extends outwardly from the larger loop 27*b*. The cleaning cloth 32 received by the larger loop 27*b* is suitable for cleaning larger bore rifles and shotguns. The cleaning cloths 31 and 32, in the preferred embodiment, are highly absorbent and are made of a composition of cotton and paper. The cleaning cloth 32 received by the larger loop 27*b* is preferably multi-layered for improved strength and durability. Such cleaning cloths are commercially available.

Figure 8:
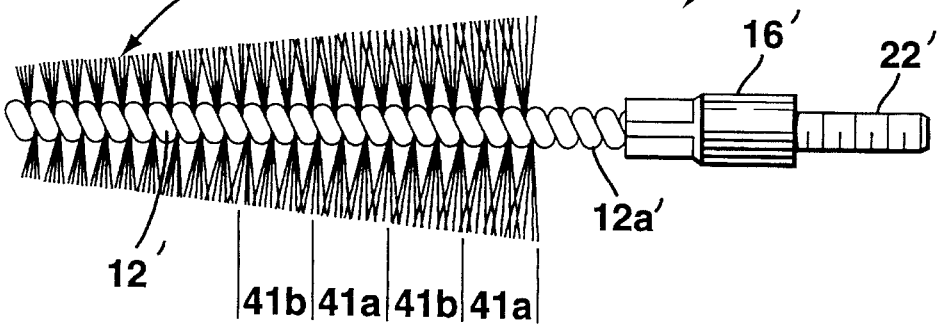
FIG. 8, when combined with FIG. 9, is an elevational view of a modification of the brush shown in FIGS. 1 and 7.
Figure 9:
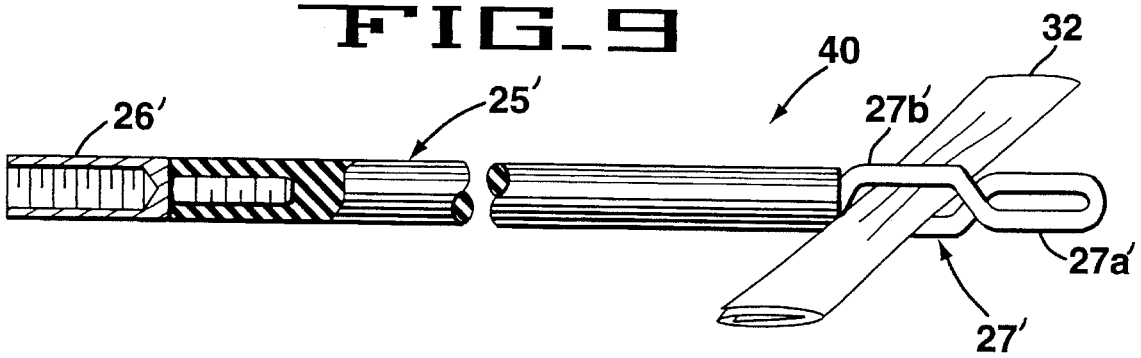
FIG. 9 is an elevational view, partially in section, of a handle and a cleaning cloth and when combined with FIG. 8 illustrates a brush embodying the present invention.

Illustrated in FIGS. 8 and 9, when FIGS. 8 and 9 are placed side-by-side with FIG. 9 to the right of FIG. 8, is a brush 40 that is a modification of the brush 10 shown in FIGS. 1 and 7. Parts of the brush 40 that are similar in structure and operation to the parts of the brush 10 are shown with the same reference numeral, but with a prime suffix.

The brush 40 differs from the brush 10 in that the bristles 41 thereof collectively have a tapered configuration in the fore and aft direction of the twisted wire 12' as shown in FIG. 8. The bristles 41 comprise nylon bristles 41*a* and metal bristles 41*b*. In the exemplary embodiment, the metal bristles 41*b* are made of phosphor bronze. The nylon bristles 41*a* and the phosphor bronze bristles are arranged in alternate and successive groups along the twisted wire 12' with the group of nylon bristles 41*a* disposed on each side of the phosphor bronze bristles 41*b*. By virtue of the bristles 41 being tapered in the fore and aft direction,, the brush 40 is capable of cleaning various size bores of gun barrels.

Figure 10:
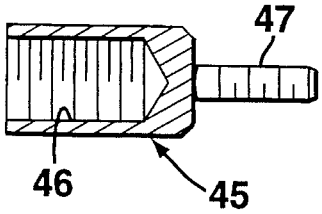
FIG. 10 is a fragmentary elevational view, partially in section, illustrating an adapter for attaching a handle to a handle support sleeve.

Illustrated in FIG. 10 is an adapter 45 that is internally threaded at 46 to receive the proximal end 22 of the sleeve 16 (FIG. 1) and is externally threaded at 47 for threaded engagement with the internally threaded sleeve 26 (FIG. 7) of the handle 25. The adapter 45 is a shotgun adapter employing standard threading to accommodate larger size threaded connections employed with larger size bristle arrangements that are used in the cleaning of bores of a shotgun.

Figure 11:
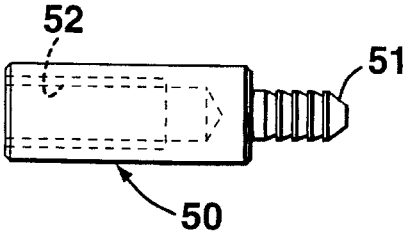
FIG. 11 is a fragmentary elevational view of a modification of a sleeve for attaching the handle to a twisted wire holding the bristles.

Illustrated in FIG. 11 is a sleeve 50 which may be used in lieu of the sleeve 16 (FIG. 1). The sleeve 50 employs angular or inclined teeth 51 in lieu of the externally threaded proximal end 22 (FIG. 1) for attachment to the internally threaded sleeve 26 that is secured to the confronting end of the handle 25. The bristle free segment 12*a* of the twisted wire 12 (FIG. 1) is fixedly secured within a bore 52 of the sleeve 50. The sleeve 50 is made of suitable material, such as aluminum, and the securement of the sleeve 50 to the bristle free segment is made by crimping or pinching the walls surrounding the bore 52 after the twisted wire segment 12*a* has been inserted into the bore 52.

What is claimed is:

1. A brush for cleaning the bore of a gun barrel comprising:

(a) wire means having a first segment for the securement of brush bristles and a second segment free of brush bristles;

(b) a plurality of groups of metal bristles and a plurality of groups of nylon bristles being successively and alternately secured to said first segment of said wire means in annular orientation for said nylon bristles to provide elasticity and reboundability to said metal bristles for flexibility and for inhibiting permanent deformation of said metal bristles; and (c) handle support means attached to said second segment.

2. A brush as claimed in claim 1 wherein said groups of metal bristles comprise phosphor bronze bristles.

3. A brush as claimed in claim 1 wherein said nylon bristles include colored filaments arranged in a color scheme to identify specific brushes for cleaning a bore of a specific caliber gun.

4. A brush as claimed in claim 1 wherein said plurality of metal bristles and said plurality of nylon bristles are formed into segregated groups.

5. A brush as claimed in claim 1 wherein said handle support means has a proximal end, said brush comprising a handle secured to the proximal end of said handle support means, said handle comprising a plurality of loops at its proximal end for the attachment of cleaning cloths.

6. A brush as claimed in claim 5 wherein said handle support means comprises a sleeve, said sleeve of said handle support means comprising an internally threaded section to receive said wire means and an externally threaded section for securing said handle to said second segment of said wire means.

7. A brush as claimed in claim 5 wherein said handle support means comprises a sleeve, said sleeve of said handle support means comprising an internally threaded section to receive said wire means and an external inclined teeth section, said handle comprising a sleeve at the end thereof opposite the end having said loops, said sleeve of said handle receiving said external inclined teeth section of said handle support means for securing said handle to said second segment of said wire means.

8. A brush as claimed in claim 5 wherein said handle is made of a flexible, solid plastic body and said plurality of loops includes a twisted wire shaft that pierces and penetrates said flexible, solid plastic body for securing said plurality of loops to said flexible, solid plastic body.

9. A brush for cleaning the bore of a gun barrel comprising:

(a) wire means having a first segment for the securement of brush bristles and a second segment free of brush bristles;

(b) brush bristles secured to said first segment of said wire means comprising a plurality of nylon bristles and a plurality of metal bristles projecting radially from said wire means, said plurality of nylon bristles and said plurality of metal bristles being arranged in a successive and alternate manner with said plurality of nylon bristles disposed on each side of said plurality of metal bristles in annular orientation for said nylon bristles to provide elasticity and reboundability to said metal bristles for flexibility and for inhibiting permanent deformation of said metal bristles; and (c) handle support means attached to said second segment.

10. A brush as claimed in claim 9 wherein said metal bristles comprise phosphor bronze bristles.

11. A brush as claimed in claim 9 wherein said plurality of metal bristles and said plurality of nylon bristles are formed into segregated groups and are arranged in successive and alternate sections.

12. A method of constructing a brush having metal bristles and nylon bristles secured to a wire, said method comprising the steps of:

(a) securing a plurality of said nylon bristles in a first section of said wire; and (b) securing a plurality of said metal bristles in a second section of said wire to form alternate groups of said nylon bristles and alternate groups of metal bristles in successive sections of said wire, said alternate groups of said nylon bristles and said metal bristles being secured in successive sections of said wire provide nylon bristles on each side of said metal bristles in annular orientation for said nylon bristles to provide elasticity and reboundability to said metal bristles for flexibility and for inhibiting permanent deformation of said metal bristles.

13. The method according to claim 12 and further comprising the step of arranging bristles to form alternate and successive structure of colored nylon bristles relative to metal bristles to provide a color code for identifying a specific brush size among a batch of several sizes of brushes.

* * * * *